US009441645B2

(12) United States Patent
Mullen

(10) Patent No.: US 9,441,645 B2
(45) Date of Patent: Sep. 13, 2016

(54) PROPORTIONAL SERVO HYDRAULIC CONTROL VALVE

(71) Applicant: Patrick Michael Mullen, San Juan Bautista, CA (US)

(72) Inventor: Patrick Michael Mullen, San Juan Bautista, CA (US)

( * ) Notice: Subject to any disclaimer, the term of this patent is extended or adjusted under 35 U.S.C. 154(b) by 316 days.

(21) Appl. No.: 14/218,250

(22) Filed: Mar. 18, 2014

(65) Prior Publication Data

US 2014/0352524 A1 Dec. 4, 2014

Related U.S. Application Data

(63) Continuation-in-part of application No. 13/904,985, filed on May 29, 2013, now Pat. No. 9,316,237.

(51) Int. Cl.
*F15B 13/04* (2006.01)
*F15B 13/044* (2006.01)

(52) U.S. Cl.
CPC ..... *F15B 13/0444* (2013.01); *F15B 13/0406* (2013.01); *F15B 2211/327* (2013.01); *F15B 2211/6313* (2013.01); *F15B 2211/6336* (2013.01); *F15B 2211/665* (2013.01); *F15B 2211/76* (2013.01); *F15B 2211/7656* (2013.01)

(58) Field of Classification Search
CPC ..... F01L 33/02; F15B 13/0406
USPC ..... 91/392, 403; 251/129.01, 129.11, 251/129.13
See application file for complete search history.

(56) References Cited

U.S. PATENT DOCUMENTS 3,134,403 A * 5/1964 Rudelick ..... F16K 11/0856 137/596.15
3,735,669 A * 5/1973 Henke ..... F15B 21/02 91/1
3,918,493 A * 11/1975 Tobias ..... F16K 11/072 137/625.23
4,308,892 A * 1/1982 Van Ausdal ..... F16K 27/041 137/624.18
4,442,755 A * 4/1984 Rozycki ..... F15B 21/125 137/624.13
4,505,184 A * 3/1985 McDonald ..... G05B 19/44 137/624.13
4,794,309 A * 12/1988 Saito ..... G05D 17/02 251/129.13
4,800,924 A * 1/1989 Johnson ..... F16K 11/0853 137/625.23
5,954,093 A * 9/1999 Leonard ..... F15B 13/0406 137/624.13
6,269,838 B1 * 8/2001 Woodworth ..... F15B 13/0406 137/625.22
6,435,205 B1 * 8/2002 Hattori ..... F15B 13/0814 137/271
6,594,992 B1 * 7/2003 Naito ..... F15B 11/17 137/625.17
6,755,115 B2 * 6/2004 Stoll ..... F15B 15/2892 91/363 R
7,401,541 B2 * 7/2008 McCarroll ..... F15B 9/09 91/392

* cited by examiner

*Primary Examiner* — Thomas E Lazo
(74) *Attorney, Agent, or Firm* — Donald R. Boys; Central Coast Patent Agency, Inc.

(57) ABSTRACT

A system has an actuator having a rotor or a linear piston, and ports for hydraulic fluid, an electro-mechanical sensor sensing position of the rotor or linear piston, a valve having a 1 plug in a bore of a valve body, the plug having cross bores aligning with passages within the valve body communicating inlet and outlet ports depending on relative position of the plug in the bore of the valve body, a servo motor to move the plug around or along the axis to different positions to align individual ones of the cross bores with individual ones of the passages communicating with individual ones of the ports, and a programmable controller coupled to the electro-mechanical sensor and to the servo motor, the controller enabled to control the servo motor to accomplish programmed movement and position of the rotor or linear piston of the hydraulically-driven actuator.

16 Claims, 8 Drawing Sheets

PROPORTIONAL SERVO HYDRAULIC CONTROL VALVE

CROSS-REFERENCE TO RELATED APPLICATIONS

The present invention is a continuation-in-part of a pending U.S. application Ser. No. 13/904,985 filed May 29, 2013, and incorporates at least by reference all of the disclosure of that prior application.

BACKGROUND

1. Field of the Invention

The present invention is the technical area of controlling hydraulic actuators, and pertains more particularly to precise control of movement of hydraulic cylinders and rotary hydraulic motors.

2. Description of Related Art

Hydraulic motivation of cylinders and motors is quite well-known in the art. There are always areas for improvement, however, and in the field of robotics in particular there is a need for very precise control of position and rate of change, acceleration, and force. The present invention addresses these unmet needs.

SUMMARY

A system is provided comprising a hydraulically-driven actuator having one of a rotor or a linear piston, and ports for hydraulic fluid to move the rotor or linear piston in either of two directions to different positions, an electro-mechanical sensor enabled to sense position of the rotor or linear piston, a valve having a substantially cylindrical plug in a bore of a valve body, the plug having cross bores at right angles to an axis of the plug, the cross bores aligning with passages within the valve body communicating with individual ones of a plurality of inlet and outlet ports to and from the valve body, depending on relative position of the plug in the bore of the valve body, a servo motor coupled mechanically to the cylindrical plug in a manner to move the plug around or along the axis to different positions to align individual ones of the cross bores with individual ones of the passages communicating with individual ones of the ports, and a programmable controller coupled to the electro-mechanical sensor and to the servo motor, the controller enabled to control the servo motor to accomplish programmed movement and position of the rotor or linear piston of the hydraulically-driven actuator.

In one embodiment the hydraulically-driven actuator is a linear cylinder, and the electro-mechanical sensor comprises a linear-potentiometer enabled to detect linear position of a piston within the linear cylinder. Also in one embodiment the programmable controller is enabled to determine velocity and acceleration of the piston from position information and passage of time.

Also in one embodiment the hydraulically-driven actuator is a rotary hydraulic motor, and the electro-mechanical sensor comprises a detector enabled to detect radial position of a driven rotor within the hydraulic motor.

In one embodiment the programmable controller is enabled to determine velocity and acceleration of the rotor from position information and passage of time. Also in one embodiment the servo motor is coupled to the cylindrical plug by gears to rotate the plug around the axis to different positions to align individual ones of the cross bores with individual ones of the passages communicating with individual ones of the ports. In one embodiment the servo motor is coupled to the cylindrical plug by gears and by a cam arrangement, to rotate the plug around the axis to different rotary positions and to different linear positions along the axis of the plug to align individual ones of the cross bores with individual ones of the passages communicating with individual ones of the ports.

In another embodiment the system further comprises pressure sensors in hydraulic lines proceeding from the valve to the actuator, the sensors providing information to the controller enabling pressure to be used as a variable in a program executed by the controller. Also in one embodiment the controller is coupled to a computerized appliance enabled to execute software enabling a user to prepare and upload programs for the controller to execute.

In another aspect of the invention a method is provided for controlling movement of a hydraulically-driven actuator, comprising steps of (a) connecting outlet ports of a hydraulic control valve having a valve body to ports of a hydraulically-driven actuator having one of a rotor or a linear piston, and ports for hydraulic fluid to move the rotor or linear piston in either of two directions to different positions, (b) providing an electro-mechanical sensor enabled to sense position of the rotor or linear piston, (c) moving a cylindrical plug having an axis and cross-bores substantially at right angles to the axis, by a servo motor coupled to the plug, in a bore of the valve body, to align individual ones of the cross bores with individual ones of a plurality of inlet and outlet ports to and from the valve body, depending on relative position of the plug in the bore of the valve body, (d) sensing positions of the rotor or linear piston by the electro-mechanical sensor and transmitting the position information to a programmable controller coupled to the servo motor and to the electro-mechanical sensor, and (e) controlling the servo motor to accomplish programmed movement of the rotor or linear piston of the hydraulically-driven actuator.

In one embodiment of the method the hydraulically-driven actuator is a linear cylinder, and the electro-mechanical sensor comprises a linear-potentiometer enabled to detect linear position of a piston within the linear cylinder. Also in one embodiment the programmable controller is enabled to determine velocity and acceleration of the piston from position information and passage of time. Also in one embodiment the hydraulically-driven actuator is a rotary hydraulic motor, and the electro-mechanical sensor comprises a detector enabled to detect radial position of a driven rotor within the hydraulic motor.

In one embodiment the programmable controller is enabled to determine velocity and acceleration of the rotor from position information and passage of time. Also in one embodiment the servo motor is coupled to the cylindrical plug by gears to rotate the plug around the axis to different positions to align individual ones of the cross bores with individual ones of the passages communicating with individual ones of the ports. And in one embodiment the servo motor is coupled to the cylindrical plug by gears and by a cam arrangement, to rotate the plug around the axis to different rotary positions and to different linear positions along the axis of the plug to align individual ones of the cross bores with individual ones of the passages communicating with individual ones of the ports.

BRIEF DESCRIPTION OF THE FIGURES

Detailed description of some embodiments of the invention is made below with reference to the accompanying figures, wherein like numerals represent corresponding parts of the figures.

DETAILED DESCRIPTION OF THE INVENTION

Figure 1:
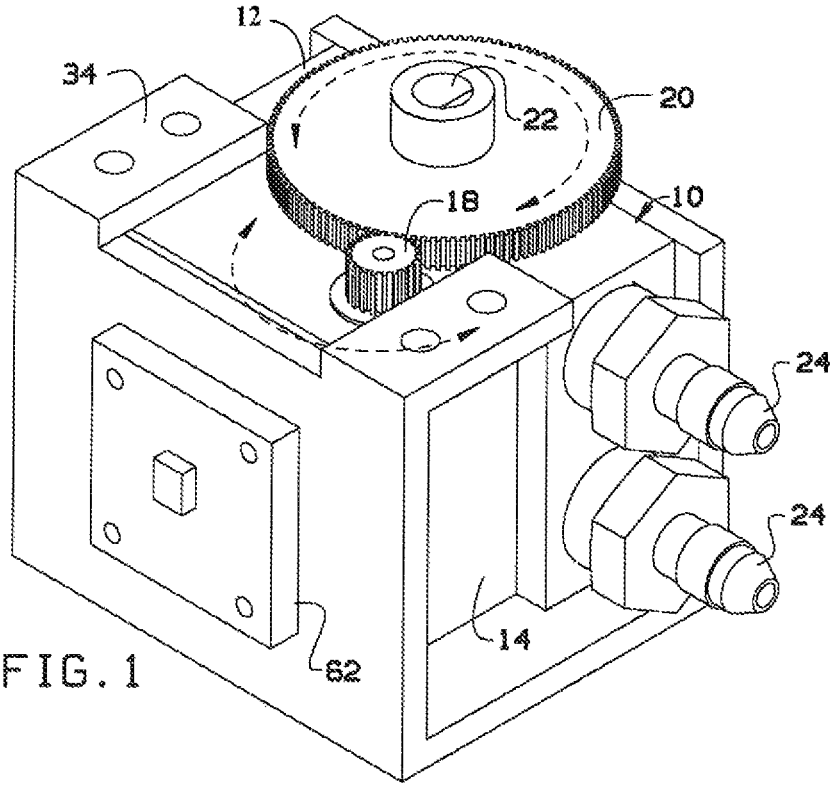
FIG. 1 is a perspective view in one embodiment of the invention.
Figure 2:
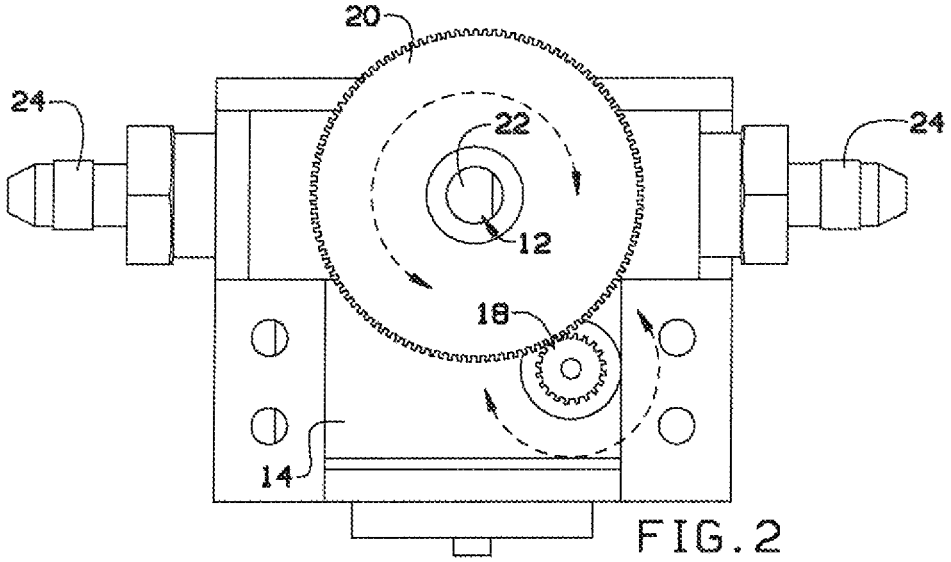
FIG. 2 is a top view of the embodiment of FIG. 1.

By way of example, and referring to FIGS. 1 and 2, one embodiment of the present inventive multi-port valve system 10 comprises a valve 12 and a servo motor 14 within a valve body housing 34. The system comprises a plurality of fluid ports 24 configured for the delivery of fluid to and from the valve system. In the example illustrated herein, there are four ports 24. However, the number of ports, and the arrangement of those ports relative to each other is not limited as shown, but indeed may include more than four ports and may orient the ports to have some being parallel to each other, perpendicular to each other, or any other one of a number of possible configurations within the housing 34.

Figure 3:
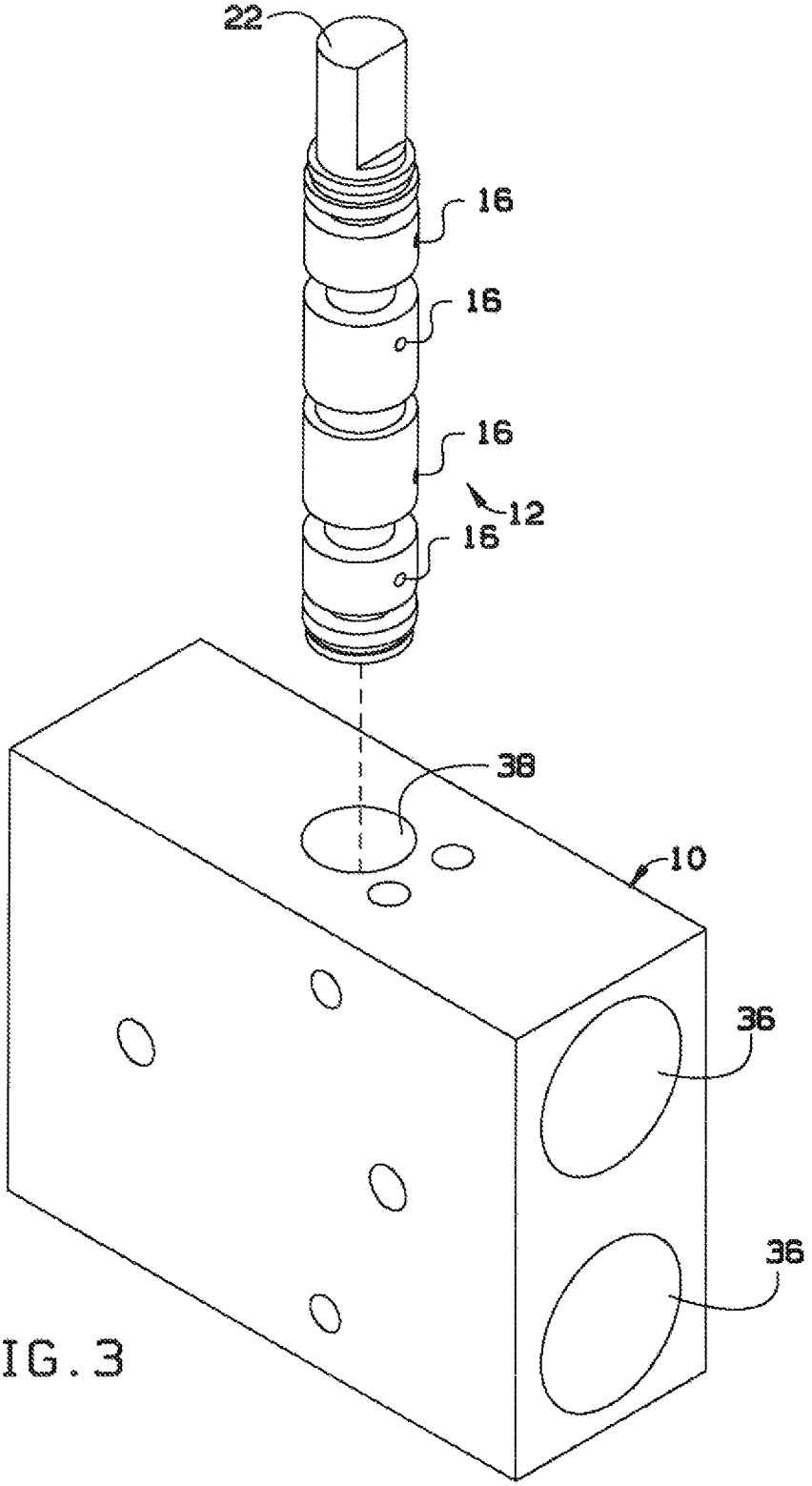
FIG. 3 is an exploded view of the valve plug and valve body of the embodiment of FIG. 1.

Referring to FIG. 3 momentarily, the valve 14 comprises a valve plug 22 configured to be housed within a valve plug bore 38 within the valve body of the multi-port valve system 10. In one embodiment, the valve plug comprises a plurality of holes 16 therethrough, where each of the plurality of holes 16 are spaced axially along the length of the valve plug 22. At least one set of holes 16 is aligned parallel to each other (in this example of embodiment the top hole and the second from the bottom hole), while another set of holes 16 is also aligned parallel to each other (in this example of embodiment the second hole from the top and the bottom hole), but out of alignment with the first set. Of course, the set of holes may be arranged in any number of configurations and radial positions, as may be appreciated further below. And additional holes and/or sets of holes may be employed where additional fluid ports are desired for the valve to control.

With reference back to FIGS. 1 and 2, in this embodiment, the servo motor 14 is configured to have a mechanical output which, in this case, is in the form of a servo gear 18 configured to rotate in clockwise and counterclockwise motion. Servo gear 18 is preferably positioned to be in engagement with valve gear 20 that is affixed to valve plug 22 so that rotation of the servo gear 18 causes rotation of valve gear 20, to drive rotation of valve plug 22. Such rotation of the valve plug 22 causes the first and second holes to come within and without of alignment with fluid pathway ports, as described below.

It should be noted that the radial size and number of teeth in the servo motor gear 18 and the valve gear 20 are set dependent upon the desired control of valve movement and the mechanical output of the servo motor. The larger or smaller the ratio between gears impacts the speed of movement of the valve. In some cases, it may be desired to have very small movement of the valve plug to correspond with fine piston movement within the hydraulic cylinder. In other cases, micro-movement control may not be necessary, so that the gear ratio may be smaller.

Importantly, it should be noted that movement of the valve plug 22 within valve plug bore 38 need not be limited to rotational movement, but indeed may comprise axial movement instead of rotational movement or in addition to rotation movement. Axial movement may be achieved via a combination of bevel gears, or a rack and pinion arrangement, for example, where the servo motor may drive axial movement of the valve plug. It may also be desired that the valve plug be spring loaded either axially or rotationally where the combination of the servo motor and the force of the spring act to control fine movement of the valve plug relative to the valve plug bore. It is contemplated that a number of possible configurations may be employed to cause the valve plug to bring into alignment certain of the valve plug holes with ports that extend radialy outward from the valve plug bore 38, as described further below.

Figure 6:
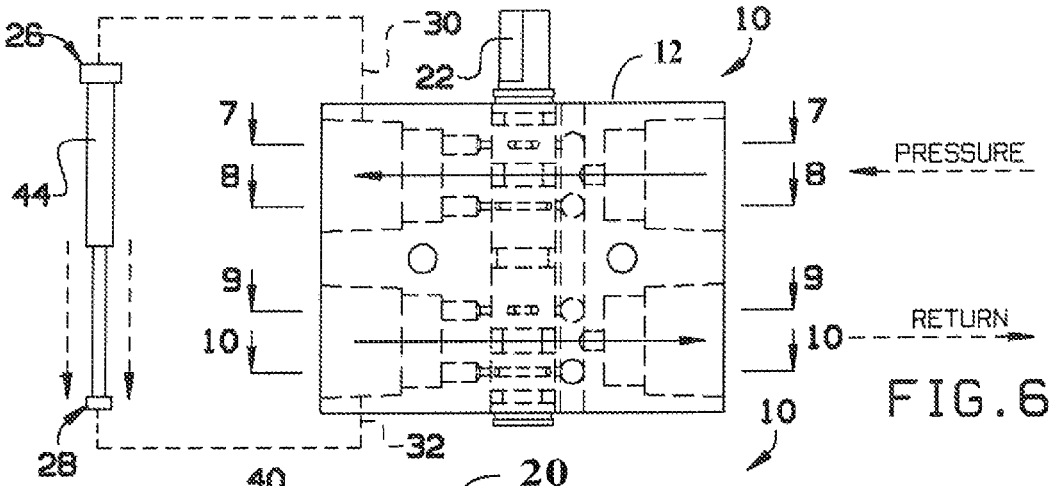
FIGS. 6, 11 and 16 are schematic side views of the valve body of FIG. 3 shown in connection with an example of hydraulic cylinder in a first open position, a closed position, and a second open position, respectively.
Figure 21:
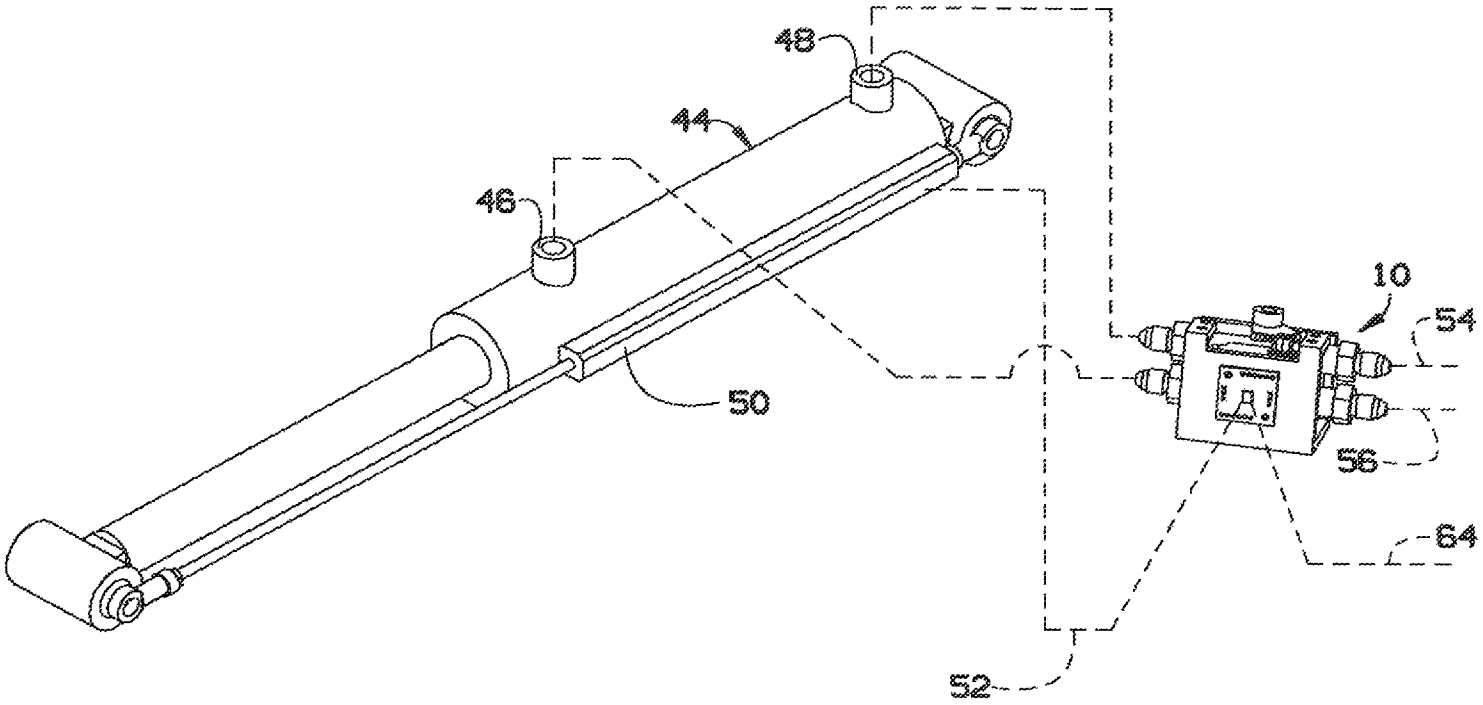
FIG. 21 is a schematic perspective view of the system embodiment of FIG. 1 shown in electrical and fluid connection with an example of a hydraulic cylinder employing a linear detection sensor, such as a linear-potentiometer, by example.

Regardless of how the valve plug 22 moves within valve plug bore 38, the holes 16 are brought into and out of alignment with ports to control the flow of fluid through the valve body ports 24 in a manner that permits, at least in one application, the actuation of a hydraulic cylinder, for example. In FIG. 6, one example of hydraulic cylinder 26 comprises a cylinder housing 44 and a piston 28. With reference to FIG. 21, the position of the piston 28 relative to the cylinder housing 44 is controlled by the delivery of fluid from the multi-port servo embodiment 10 of the present invention through valve body ports 24 to and from cylinder ports 46 and 48, where the source of fluid pressure (e.g., pump—not shown) is supplied to the valve body 10 through line 54 and returned to the source of fluid pressure through line 56, both connected to the other set of valve body ports 24.

Referring back to FIG. 3, the valve body 34 comprises valve port bores 36 into which valve ports 24 may be affixed (in one of numerous possible mechanical and/or adhesive connections), depending upon the material chosen for the valve ports 24 and the valve body 34. In a high-pressure hydraulic fluid system, the valve body 34 and the valve ports 24 are both made of high strength metals capable of withstanding the high pressures associated with the control of hydraulic cylinders. As may be appreciated, the valve plug 22 comprises a generally cylindrical configuration that may include parallel surfaces and/or tapered surfaces between holes 16, or a single or plurality of grooves along the axial length. The grooves may provide functional value of being aligned within internal collars within the valve plug bore, in some examples, or may simply reflect the addition of material around the holes for enhanced structural integrity to withstand high pressure flows.

Figure 4:
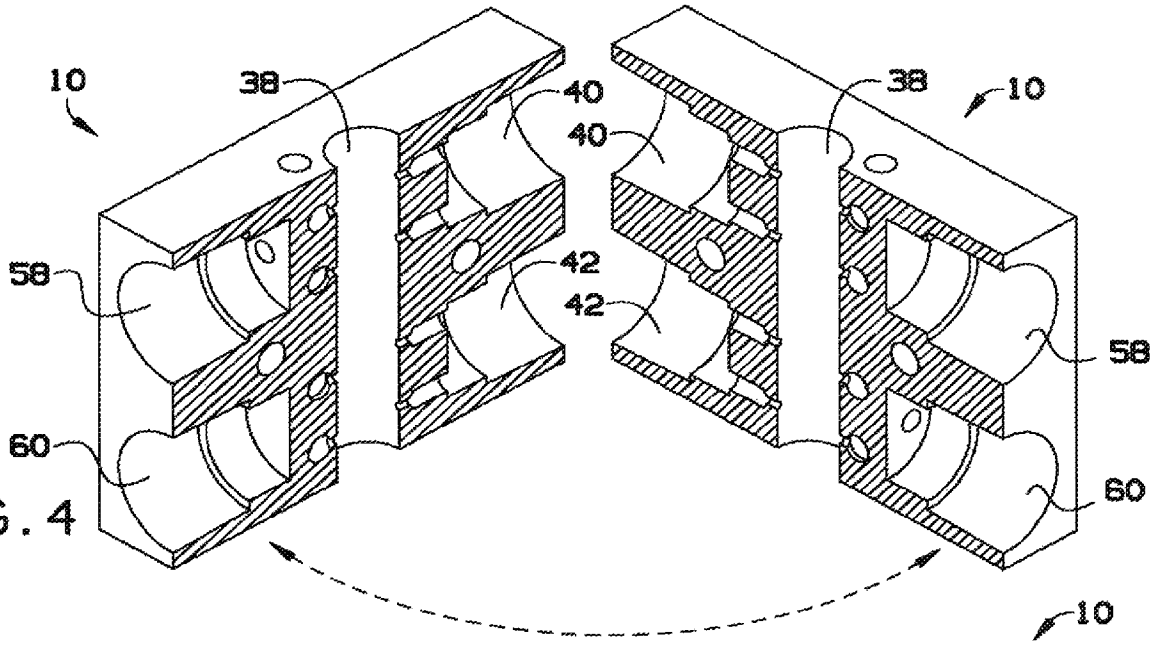
FIG. 4 is a cross-sectional perspective view of the valve body of FIG. 3.
Figure 5:
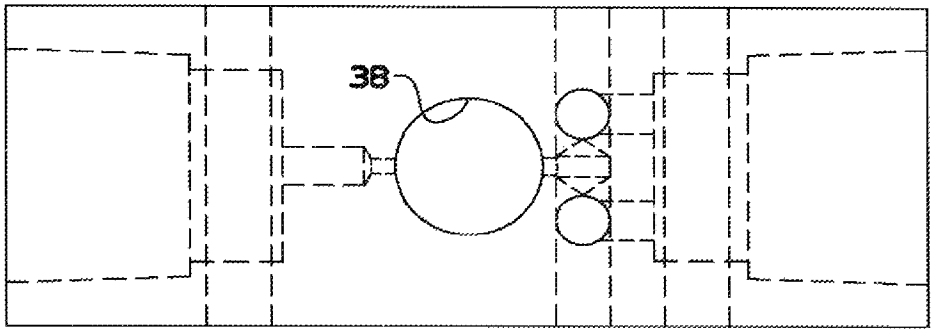
FIG. 5 is a top view of the valve body of FIG. 3.

With reference to FIGS. 4 and 5, one example of a series of fluid pathways within the valve body housing 34 may be described, where the fluid pathways permit fluid communication between the valve ports 24 through holes 16 of valve plug 22. In one embodiment of the multi-port valve body, the port bores comprise one bore 40 connected to one cylinder port 48 and another valve body port bore 42 connected to cylinder port 46. Likewise, valve body port 58 is connected to the fluid delivery line 54 from the pressure source while valve body port 60 is connected to the fluid return line 56 to the pressure source. The internal pathways within the valve body housing 34, combined with the controlled movement of the valve plug 22 within valve plug bore 38—and the concomitant alignment of holes 16 with radial ports of the valve plug bore—permit the controlled direction of fluid from fluid delivery port 58 to either cylinder ports 40 or 42 for the alternating control of piston movement in one linear direction or the other. In the example of multi-port valve body system shown here, a plurality of bores generally aligned parallel to the valve plug bore 38 are in respective communication with a port in each of the delivery and return ports 58 and 60, on the one hand, and a set of valve plug bore ports, on the other hand.

Figure 7:
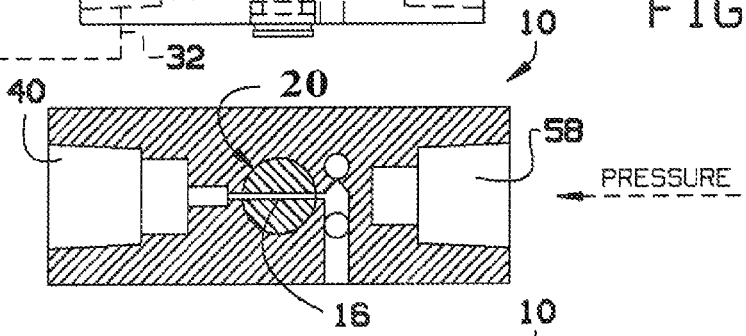
FIGS. 7-10, FIGS. 12-15 and FIGS. 17-20 are cross-sectional views of the valve body of FIG. 3 taken through cross-section lines designated in FIGS. 6, 11 and 16, showing the relative position of the valve plug vis-à-vis the valve body when the valve is in a first open position, a closed position, and a second open position, respectively.
Figure 8:
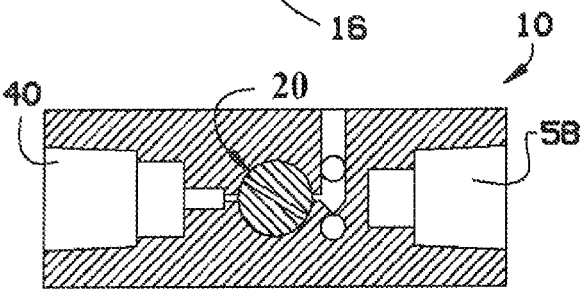
Figure 9:
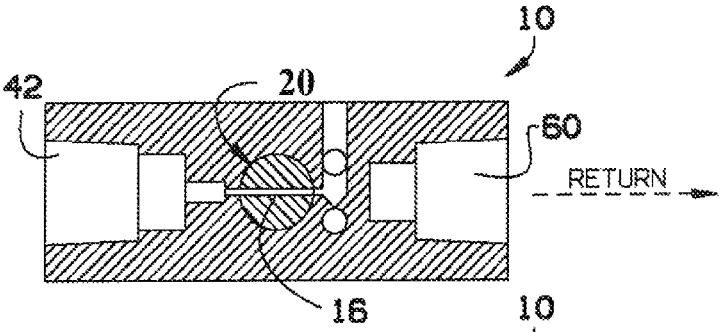
Figure 10:
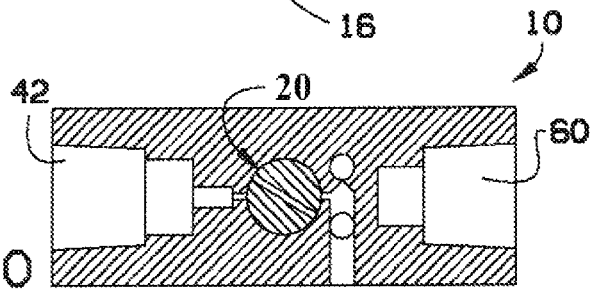
Figure 11:
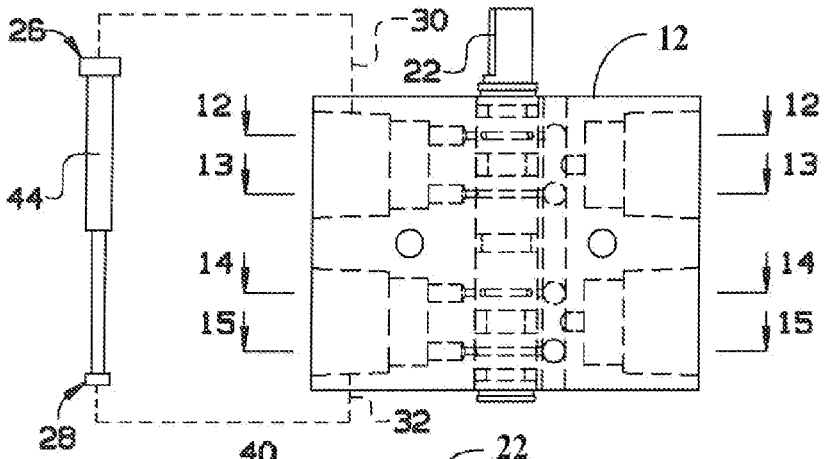
Figure 12:
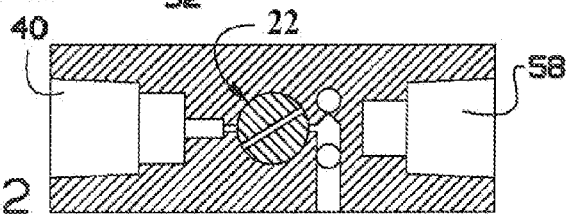
Figure 13:
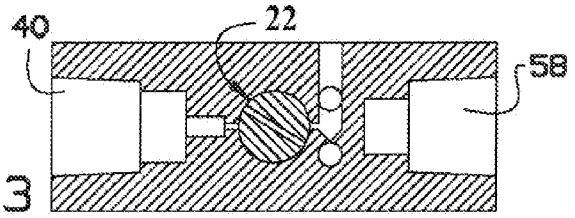
Figure 14:
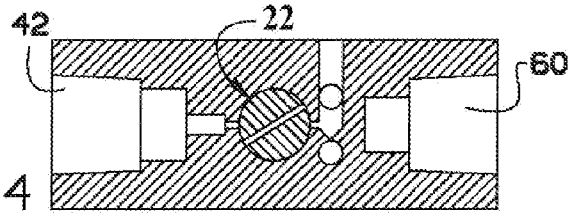
Figure 15:
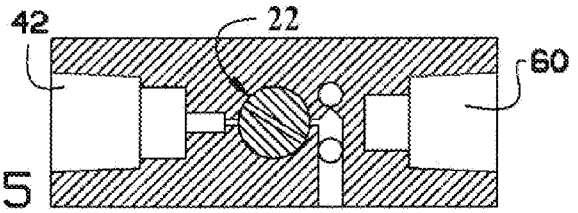
Figure 16:
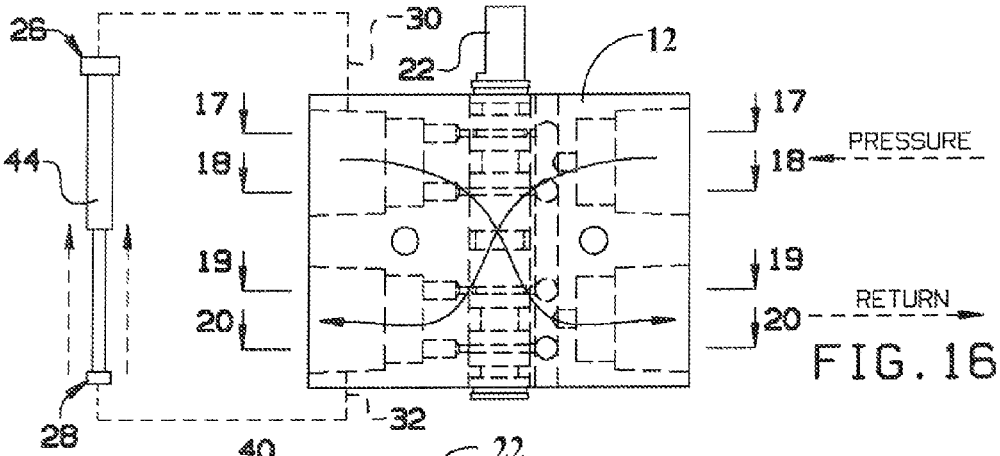
Figure 17:
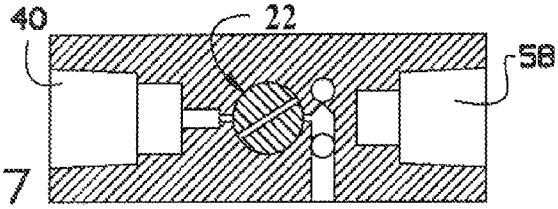
Figure 18:
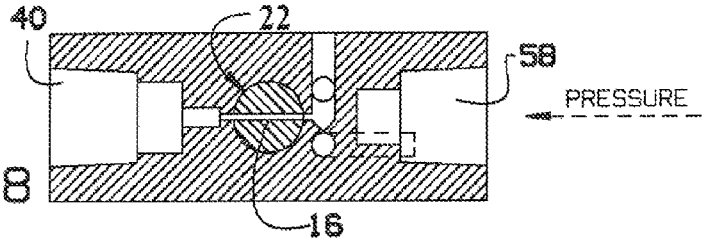
Figure 19:
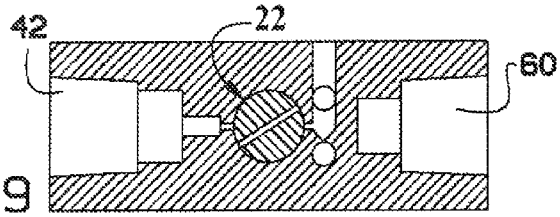
Figure 20:
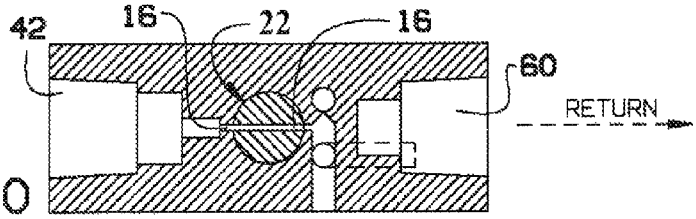

Referring to FIGS. 6 though 20, the sequence of operation may be appreciated, where the relative position of the valve plug 22 (and holes 16) within the valve plug bore 38 is shown in three different positions: a first valve open position (shown in FIGS. 6 through 10), a closed position (shown in FIGS. 11-15), and a second valve open position (shown in FIGS. 16-20). Each cross-section view associated with schematic FIGS. 6, 11 and 16 show the relative position of each of the holes 16 relative to a corresponding valve plug bore port. For example, in FIG. 7, the upper most hole is shown in fluid communication with cylinder port 40, while the second hole from the bottom is in fluid communication with cylinder port 42, as shown in FIG. 9. Meanwhile, the second hole from the top and the bottom most hole are not in fluid communication with any port. The result, as shown in FIGS. 6 and 21, is that the fluid delivery line 54 permits fluid to flow through valve body port 58 directly to valve body port 40 and then to cylinder port 48, with the return of fluid coming from cylinder port 46 through valve body port 42 through to valve body port 60 and back to the pressure source.

With reference to FIGS. 11 through 15, the position of valve plug 22 within valve plug bore 38 is such that none of the valve plug holes 16 are in fluid communication with any ports. Thus, the valve is essentially closed and no flow is occurring between the pressure source, the valve body and the hydraulic cylinder. It should be note that the static pressure may be such that overtime, the pressure may cause undue stress on one or more of the components. Thus, it may be desirable to include within the system a pressure-relief valve to permit the exhaust of at least some of the fluid to a sink or simply to the ambient to temporarily reduce the pressure until the valve is turned back on to the first or second valve open positions.

Referring to FIGS. 16 through 20, relative position of the valve plug 22 and the valve plug bore 38 is shown. There, the valve plug holes 16 are aligned such the resultant flow path is shown by the arrows in FIG. 16 to reflect the flow of fluid from delivery line 54 permits to valve body port 58 directly to valve body port 42 and then to cylinder port 46, with the return of fluid coming from cylinder port 48 through valve body port 40 through to valve body port 60 and back to the pressure source. This alternating "second" valve open position directs the piston in the opposite linear direction as results when the valve is in the "first" valve open position. Thus, reciprocating piston movement may be controlled within the hydraulic cylinder 44 to accomplish the task desired. Importantly, it should be noted that the orientation of the fluid paths and ports within the valve body example illustrated and described herein may be varied considerably and still achieve the desired fluid dynamic result.

Referring back to FIGS. 1 and 2, as well as FIG. 21, the automated control feature of embodiments of the present invention may be described. In that regard, embodiments of the multi-port servo valve system comprises a control circuit assembly 62 that may be affixed directly to the valve housing 34 or simply electrically connected to the valve housing in one form of the other, either wired or wirelessly. Preferably, the circuit assembly 62 comprises a controller 64 that may be programmed to designate the desired linear position of piston 28 within the cylinder housing 44 over time. In that regard, a sensor 50 is provided in association with the hydraulic cylinder 26, either directly attached to the cylinder housing 44 or linked in some other configuration, to detect that position of the piston 28 within the housing 44 at any one moment in time. The position is continuously or periodically fed to the controller 64 so that the controller may compare in real time or periodically the actual position of the piston to the desire position of the piston. The controller is electrically connected to the servo motor, either wired or wirelessly, to direct the servo motor to actuate the valve when necessary. If the controller's programmed comparative function reveals that there is a delta between the actual and desired piston position, the servo motor may be directed to move the valve plug in one direction or the other; i.e., to a first open or second open position, to adjust the piston position accordingly. If there is no delta directed, the valve may be either actuated to a closed position or left in a closed position, depending upon where the sequence of operation is at. In one example of a sensor 50, a linear-potentiometer may be employed. Other sensors may be employed as well to provide meaningful information about the present situation of the cylinder 26 vis-à-vis the desired situation dictated by the program entered into the controller.

Indeed, other applications are possible for the inventive embodiments of the multi-port servo valve, as described herein. For example, instead of controlling the flow of hydraulic fluid to a linear piston-style hydraulic cylinder through the use of linear position feedback, the embodiments may be employed to control the movement of a rotational cylinder, where rotational movement of a rotor in one direction or the other may be controlled through the delivery and return of pressurized fluid through embodiments of the multi-port servo valve. One example of a rotational cylinder might be a hydraulic motor configured so that the rotor rotates in a single direction, but at varying speeds and/or for varying time periods., One type of feedback sensor may be one that is configured to detect the rotational position of the rotor within its housing, or the angular velocity at any point in time.

Figure 22:
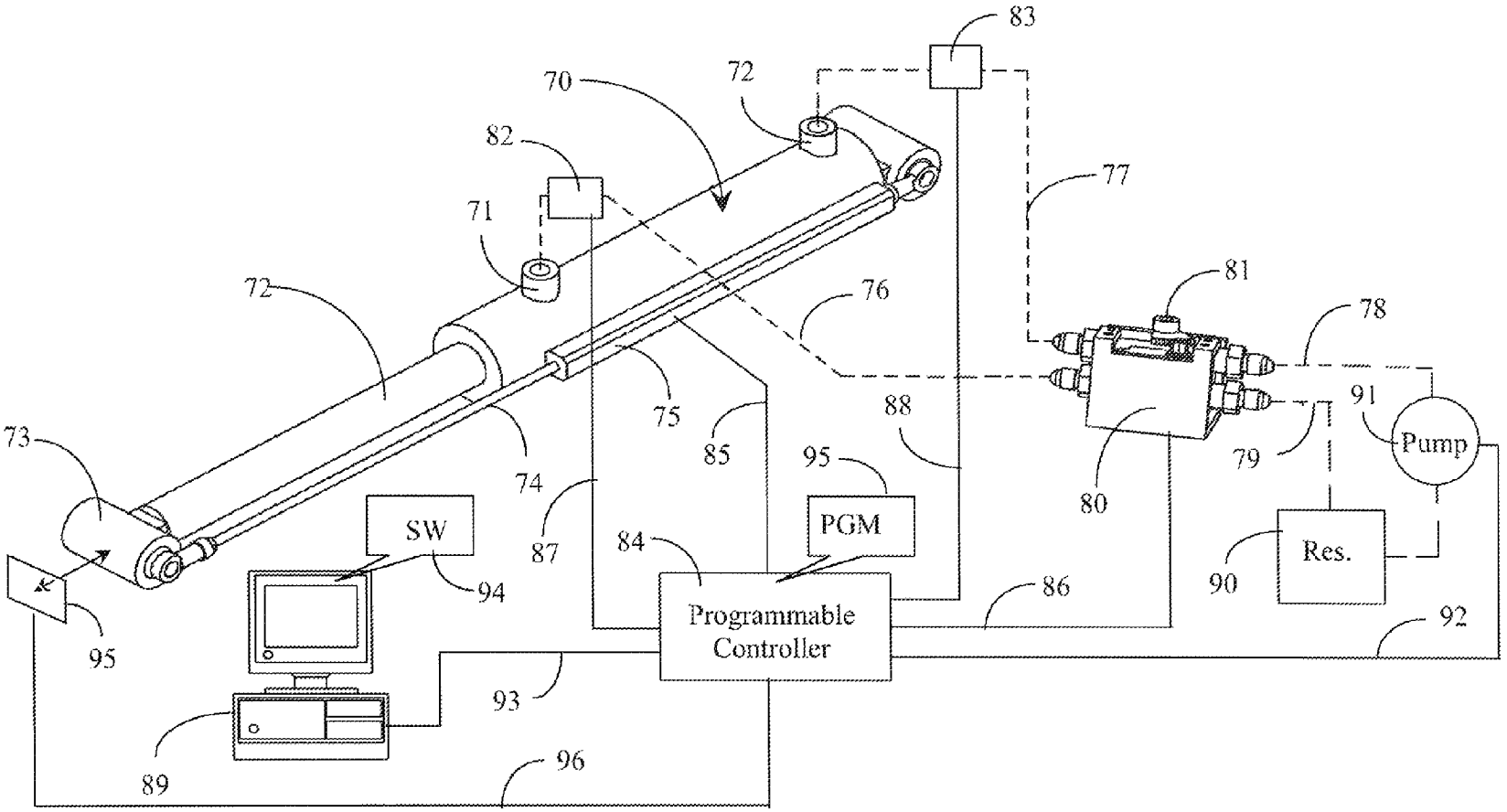
FIG. 22 is a perspective view similar to FIG. 21, adding additional detail concerning control mechanisms in embodiments of the invention.

FIG. 22 is a diagram illustrating more detail in operation and control of a hydraulic actuator in an embodiment of the invention. FIG. 22 illustrates a linear hydraulic cylinder 70, as does FIG. 21, but it should be apparent to the skilled person that cylinder 70 could also be a rotary actuator like a hydraulic motor.

In the arrangement of FIG. 22 piston 72 of the cylinder is driven in opposite directions by supply of hydraulic fluid under pressure from valve assembly 80, which includes a servo motor, and is operationally identical to valve assembly 10 in FIG. 21. Hydraulic fluid under pressure is supplied by pump 91 through conduit 78 to the valve, and depending on the rotary and linear position of valve plug 80 (equivalent to plug 22 described above, through the valve to either of conduits 76 or 77 to drive the cylinder. Cylinder 70 has a linear potentiometer 75 connected at a far end of piston 72 at element 73, such that a signal may be generated regarding the position of the piston in the cylinder. That signal is provided via line 85 to a programmable controller 84. Controller 84 also receives pressure signals from pressure sensors 82 and 83 in lines 76 and 77. Controller 84 is provided with a program 95 for cylinder operation by a coupled computerized appliance 89 running SW 94 via path 93. SW 94 provides a user with an interactive interface for preparing different programs for cylinder (actuator) operation.

Controller 84 provides signals via path 92 to operate pump 91 and via path 86 to operate the servo motor in valve assembly 80. A user may program sophisticated programs for movement of the piston of the cylinder, or for rotation of a rotor in a rotary actuator. By virtue of the fine position control of valve plug 8, described in detail above with reference to valve plug 22, one may for example, position valve bores 16 (see FIGS. 3 and 7 through 10) relative to matching bores in the valve body, such that fine speed control is attained. For example, one may program position of valve plug 81 relative to matching bores in the valve body, such that a bore 61 is not directly aligned with the matching bore, so the area for passage of hydraulic fluid is restricted, depending on the position of the valve plug. Consider the area as the full cross-sectional area of the bore 16 when alignment is direct. Then, when the valve plug begins to turn, the area diminishes over a few degrees until the flow is completely shut off. This phenomena may be used in control to get very fine changes in rate and acceleration. The same principle works in the opposite circumstance as the plug is turned from a full off position over a few degrees to a full on position.

In some embodiments of the invention pressure information from sensors 82 and 83 may be used in programming and control to control piston movement and pressure applied, which translates to force exerted by the piston, or a rotary member of a rotary actuator. Further, in some embodiments of the invention the actuator, be it a linear cylinder or a rotary actuator, may operate one or more mechanisms for pushing or pulling a load, or for gripping an object for example. Sensor 95 in FIG. 22 is meant to represent any such sensors that may be implemented in driven mechanisms to sense force against elements manifested by movement of and contact with a portion of the actuator. Such sensors provide force data to programmable controller 84 via path 96, and this data may be used in programming operation of the actuator.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system comprising:

a hydraulically-driven actuator having one of a rotor or a linear piston, and ports for hydraulic fluid to move the rotor or linear piston in either of two directions to different positions;

an electro-mechanical sensor enabled to sense position of the rotor or linear piston;

a valve having a valve body with a cylindrical bore of a first diameter having a central axis, the valve comprising a plug having one or more solid cylindrical portions of the first diameter engaged rotatably in the bore, individual ones of the solid cylindrical portions having one or more cross bores at right angles to an axis of the plug and through the cylindrical portion with openings at opposite ends of the cross bores, the openings at opposite ends of the cross bores aligning with openings of passages within the valve body communicating with individual ones of a plurality of inlet and outlet ports to and from the valve body, depending on relative position of the plug in the bore of the valve body;

a servo motor coupled mechanically to the cylindrical plug in a manner to move the plug around and along the axis to different positions to align individual ones of the cross bores with individual ones of the passages communicating with individual ones of the ports; and a programmable controller coupled to the electro-mechanical sensor and to the servo motor, the controller enabled to control the servo motor to accomplish programmed movement and position of the rotor or linear piston of the hydraulically-driven actuator.

2. The system of claim 1 wherein the hydraulically-driven actuator is a linear cylinder, and the electro-mechanical sensor comprises a linear-potentiometer enabled to detect linear position of a piston within the linear cylinder.

3. The system of claim 2 wherein the programmable controller is enabled to determine velocity and acceleration of the piston from position information and passage of time.

4. The system of claim 1 wherein the hydraulically-driven actuator is a rotary hydraulic motor, and the electro-mechanical sensor comprises a detector enabled to detect radial position of a driven rotor within the hydraulic motor.

5. The system of claim 3 wherein the programmable controller is enabled to determine velocity and acceleration of the rotor from position information and passage of time.

6. The system of claim 1 wherein the servo motor is coupled to the cylindrical plug by gears to rotate the plug around the axis to different positions to align individual ones of the cross bores with individual ones of the passages communicating with individual ones of the ports.

7. The system of claim 1 wherein the servo motor is coupled to the cylindrical plug by gears and by a cam arrangement, to rotate the plug around the axis to different rotary positions and to different linear positions along the axis of the plug to align individual ones of the cross bores with individual ones of the passages communicating with individual ones of the ports.

8. The system of claim 1 further comprising pressure sensors in hydraulic lines proceeding from the valve to the actuator, the sensors providing information to the controller enabling pressure to be used as a variable in a program executed by the controller.

9. The system of claim 1 wherein the controller is coupled to a computerized appliance enabled to execute software enabling a user to prepare and upload programs for the controller to execute.

10. A method for controlling movement of a hydraulically-driven actuator, comprising steps:

(a) connecting outlet ports of a hydraulic control valve having a valve body to ports of a hydraulically-driven actuator having one of a rotor or a linear piston, and ports for hydraulic fluid to move the rotor or linear piston in either of two directions to different positions;

(b) providing an electro-mechanical sensor enabled to sense position of the rotor or linear piston;

(c) moving a cylindrical plug having an axis and cross-bores substantially at right angles to the axis, passing through solid sections of the cylindrical plug, rotationally and linearly by a servo motor coupled to the plug, in a bore of the valve body, to align individual ones of the cross bores with individual ones of a plurality of inlet and outlet ports to and from the valve body, depending on relative position of the plug in the bore of the valve body;

(d) sensing positions of the rotor or linear piston by the electro-mechanical sensor and transmitting the position information to a programmable controller coupled to the servo motor and to the electro-mechanical sensor; and (e) controlling the servo motor to accomplish programmed movement of the rotor or linear piston of the hydraulically-driven actuator.

11. The method of claim 10 wherein the hydraulically-driven actuator is a linear cylinder, and the electro-mechanical sensor comprises a linear-potentiometer enabled to detect linear position of a piston within the linear cylinder.

12. The method of claim 11 wherein the programmable controller is enabled to determine velocity and acceleration of the piston from position information and passage of time.

13. The method of claim 10 wherein the hydraulically-driven actuator is a rotary hydraulic motor, and the electro-mechanical sensor comprises a detector enabled to detect radial position of a driven rotor within the hydraulic motor.

14. The method of claim 10 wherein the programmable controller is enabled to determine velocity and acceleration of the rotor from position information and passage of time.

15. The method of claim 10 wherein the servo motor is coupled to the cylindrical plug by gears to rotate the plug around the axis to different positions to align individual ones of the cross bores with individual ones of the passages communicating with individual ones of the ports.

16. The method of claim 10 wherein the servo motor is coupled to the cylindrical plug by gears and by a cam arrangement, to rotate the plug around the axis to different rotary positions and to different linear positions along the axis of the plug to align individual ones of the cross bores with individual ones of the passages communicating with individual ones of the ports.

* * * * *